United States Patent [19]

Skoultchi et al.

[11] Patent Number: 4,770,668

[45] Date of Patent: Sep. 13, 1988

[54] ETHYLENE UREA COMPOSITIONS USEFUL AS PERMANENT PRESS PROMOTING CHEMICALS

[75] Inventors: Martin Skoultchi, Somerset; Dilip K. Ray-Chaudhuri, Bridgewater, both of N.J.

[73] Assignee: National Starch and Chemical Corporation, Bridgewater, N.J.

[21] Appl. No.: 145,022

[22] Filed: Jan. 19, 1988

[51] Int. Cl.[4] ..... D06M 13/34; C07D 233/30

[52] U.S. Cl. ..... 8/181; 8/185; 8/189; 427/393.2; 548/317; 548/319

[58] Field of Search ..... 8/181, 185, 189, 195, 8/585; 427/393.2; 548/317, 319; 252/8.8

[56] References Cited

U.S. PATENT DOCUMENTS

| | | | |
|---|---|---|---|
| 3,112,155 | 11/1963 | Vail et al. | 548/319 |
| 3,260,565 | 7/1966 | Beachem | 548/319 |
| 3,671,307 | 6/1972 | Spangler | 8/185 |
| 4,016,335 | 4/1977 | Chao | 8/185 |
| 4,268,679 | 5/1981 | Lavanish | 71/92 |
| 4,285,690 | 8/1981 | North | 8/185 |
| 4,302,239 | 11/1981 | Lavanish | 71/88 |
| 4,303,456 | 12/1981 | Schmuck et al. | 156/78 |
| 4,332,586 | 6/1982 | North | 8/185 |
| 4,443,623 | 4/1984 | Photes | 560/170 |
| 4,536,422 | 8/1985 | Harper, Jr. | 8/181 |
| 4,619,668 | 10/1986 | Frick, Jr. et al. | 8/496 |

OTHER PUBLICATIONS

American Cyanamid brochure, "MAGME Multi--Functional Acrylic Monomer".

Ben-Ishai et al., *Tetrahedron*, 33, pp. 3261-3264 (1977).

Ben-Ishai et al., *Tetrahedron*, 33, pp. 1191-1196 (1977).

*Primary Examiner*—Paul Lieberman

*Assistant Examiner*—Helene Kirschner

*Attorney, Agent, or Firm*—Royal N. Ronning, Jr.; Edwin M. Szala

[57] ABSTRACT

This invention provides novel adducts of cyclic ethylene urea which are useful as permanent press agents. These adducts include acid, polyacid, ester, and multiester derivatives of cyclic ethylene urea and can be produced by the reaction of the cyclic ethylene urea with glyoxylic acid and glyoxylic acid derivatives, specifically ester acetals of glyoxylic acid. Such materials impart a high degree of permanent press properties to cellulose and cellulose/polymer blend fabrics.

20 Claims, No Drawings

ETHYLENE UREA COMPOSITIONS USEFUL AS PERMANENT PRESS PROMOTING CHEMICALS

BACKGROUND OF INVENTION

This invention relates to the field of permanent press compounds. Specifically this invention relates to a series of materials which are reactive with cellulose type hydroxyl groups to impart crosslinking and, therefore, permanent press properties to cellulose and cellulose blend fabrics. Such compounds have crosslinking properties similar to the more familiar formaldehyde derived adducts, currently used in permanent press application, without the use of any undesirable formaldehyde.

Treatments for fabrics composed of cellulose and mixtures of cellulose with natural or synthetic polymers to render them wrinkle resistant and self-smoothing on laundering, consist of applying and reacting a finishing agent on the cellulose. These finishing agents form crosslinks or bonds between linear cellulose molecules of which the fiber is composed and are typically made from a reaction of formaldehyde with ureas to make a polyfunctional methylolamide or hydroxymethylolamide. These methylolamides are applied from aqueous solution and, after drying, react readily with cellulose under the influence of mild catalysts. Because they have more than one reactive methylolamide group, they form bridges or crosslinks between the linear cellulose molecules, thereby imparting permanent press properties to the fabric.

While these crosslinking treatments do increase the wrinkle resistance and durable press properties of the cellulosic fabric, they also decrease the ability of the fiber to absorb moisture. This is shown by the reduced moisture content of the fabric when exposed to atmospheric moisture. Additionally, the presence of formaldehyde in the adducts renders the agents as less desirable for many applications, since formaldehyde has been linked with many health problems.

To avoid these drawbacks, researchers have tried a wide array of materials as crosslinking agents. For example, Frick, Jr. et al. (U.S. Pat. No. 4,619,668), disclose a variety of materials, produced by reaction of 1,3-dimethylurea and glyoxal, which are useful as permanent press agents. The patentees therein state that the resultant compositions produce a satisfactory degree of crosslinking, while imparting a high degree of wettability to the fabric; this wettability is important in dyeing operations, since most dyes are applied from aqueous solutions.

The use of similar compounds, including substituted imidazolidinones, is also known in the art. However, many of such materials also possess a drawback of imparting a yellow tint to the fabrics when chlorine bleach is applied, due to the presence of free amine hydrogens. Therefore the use of such materials in permanent press fabrics for wearing apparel is extremely limited.

There exists a real need for compounds which are suitable for use as cellulose crosslinking agents, which overcome the drawbacks with the prior crosslinking agents. Such compounds will impart a high degree of permanent press and smoothablity to the fabrics, yet avoid the use of toxic formaldehyde, and additionally, be obtainable in high yields, relatively stable to storage, and useful in many different applications.

SUMMARY OF INVENTION

It is an object of this invention to provide compounds suitable as crosslinking agents for cellulose fibers which can impart a desirable degree of permanent press and selfsmoothing abilities to cellulose and cellulose blend fabrics. It is further an object of this invention to provide compounds which are easily obtainable and can be obtained in high yields, which are relatively stable towards storage, and which can be modified for a variety of applications.

This invention provides novel adducts of cyclic ethylene urea which are useful as permanent press agents. The compositions of this invention have the general formula

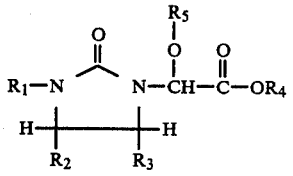

where $R_1$ is alkyl or

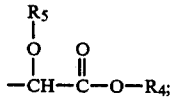

$R_2$ and $R_3$ are OH, H, or combine to form

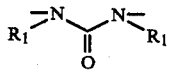

and the N atoms attach to the molecule at positions $R_2$ and $R_3$; and $R_4$ and $R_5$ are alkyl, hydroxyalkyl, or H. attach to the molecule at positions R2 and R3; and R4 and R5 are alkyl, hydroxyalkyl, or H.

These compounds can be produced by the reaction of cyclic ethylene urea with glyoxylic acid and glyoxylic acid derivatives, specifically glyoxylic ester acetals. Such materials useful as reagents herein are readily prepared by known synthetic methods, and many are available commercially. Further, while the reaction of such ester acetals with open chain ureas, such as urea itself, and heterocyclic compounds such as hydantions are known (see Tetrahedron, 33 p 1191 (1977)), there has been no mention of reaction of cyclic ureas with these ester acetals. By proper choice of ester acetal, a wide variety of novel ethylene urea esters can be prepared.

Such materials, it has been found, impart a high degree of permanent press properties to cellulose and cellulose/polymer blend fabrics. Thus, these materials form a new class of permanent press agents.

DETAILED DESCRIPTION OF INVENTION

SYNTHESIS OF COMPOUNDS

The compounds of this invention can be prepared by the reaction of a 2-imidazolidinone derivatives with glyoxylic acid or an ester acetal of glyoxylic acid to form a monoester or polyester of imidazolidinone. The product obtained depends upon the number of NH groups present in the starting molecule. The reaction to produce the monoester proceeds by the reaction of the 2-imidazolidnone derivative having only one NH group with glyoxylic acid or its ester acetal derivative. The reaction proceeds as follows:

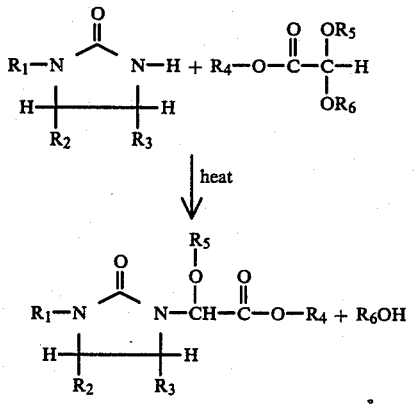

where:

$R_1$=alkyl $R_2$, $R_3$=H, or OH, $R_4$, $R_5$, $R_6$=alkyl, H, or hydroxyalkyl.

Also, $R_2$ and $R_3$ together can comprise the group

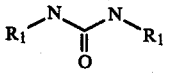

where the nitrogen atoms are attached to the imidazolidynone at the positions corresponding to $R_2$ and $R_3$ to form the following:

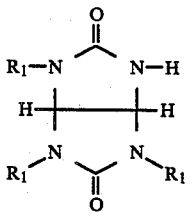

where $R_1$ has the same designation as above. A wide variety of alykl groups can be employed at $R_1$, $R_4$, and $R_5$, the choice being limited only by the available starting materials, but it is preferred that these materials will be lower alkyls ($C_1$–$C_4$).

Regardless of the starting materials (single or double ring), the reactants are mixed in a 1:1 molar ratio of NH to glyoxylic acid derivative to produce 1 equivalent of the ester and 1 equivalent of the alcohol (or water). The alcohol or water is then removed from the mixture by any standard separation technique(e.g. distallation).

The multiester product is produced by a similar process using starting materials having more than 1 NH group. In these cases, $R_1$ can be alkyl or H, and may be the same at each position or different. The diester is, thus, formed when only one $R_1$=H, as follows:

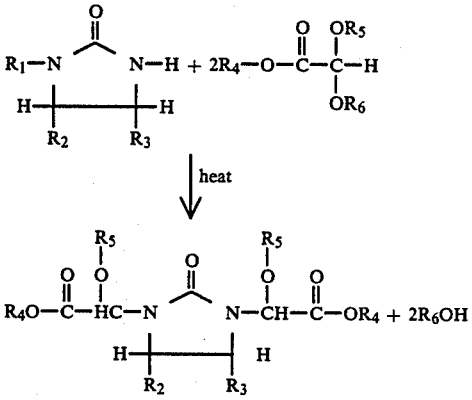

In this case 1 mole equivalent of glyoxylic acid or glyoxylic ester acetal is reacted with each mole equivalent of NH, to attach an ester group at that point.

By proper choice of the starting materials, the tri-and tetra-esters can also be formed. Substitution will occur at each N—H. Thus, if the starting material used is:

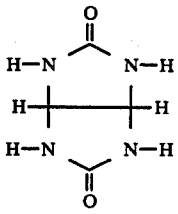

where all $R_1$=H the tetra-ester:

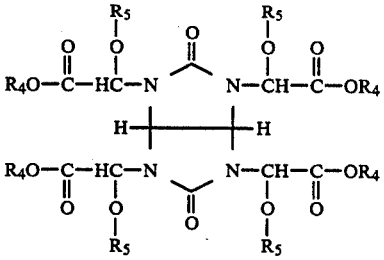

will be obtained if the glyoxylic acid or glyoxylic acid derivative is reacted with the material in a 4:1 molar ratio.

While other synthetic routes can be used to produce these compositions, the above routes exhibit the advantages of being simple and rapid, and are capable of producing the desired product in high yield. Further, because the reaction will proceed over a pH range, a variety of starting materials including hemiacetals of glyoxalic esters:

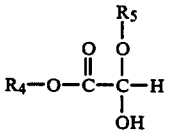

and dihydroxyimidazolidinones:

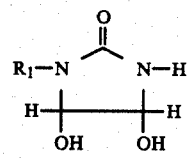

can be used with satisfactory results. Thus, a variety of novel hydroxylated compounds can be produced.

The reactions are carried out in solution with any non-reactive solvent (preferable water, ketones or hydrocarbons) or in the absence of any solvent (since most of the acid or ester acetal reactants are liquids at temperatures of 50°–180° C.). The particular temperature used will be selected based upon the reactants used, but generally the reaction with glyoxylic acid should be conducted at a temperature below 100° C. (preferably 75° C.) while the reactions with the glyoxylic ester acetals can be conducted at 130°–170° C., preferably 140°–150° C.

A benefit of this type of reaction is that the solvent and any water or alcohol produced are vaporized and removed from the product. As such, no additional purification or separation steps are required and a pure product is obtained. Further, monitoring of this vaporization provides a convenient method for ascertaining when the reaction is complete, as no further vapor formation will be observed at completion. Ordinarily, these reactions proceed at a moderate rate and will proceed to completion in less than 8 hours.

In the preferred embodiments of this invention $R_1$ is a lower alkyl ($C_1$–$C_4$) preferably methyl or ethyl; $R_4$ and $R_5$ are either lower alkyl ($C_1$–$C_4$) or the hydroxyl derivatives of these groups with methyl and ethyl being the preferred alkyls and hydroxymethyl and hydroxyethyl being the preferred hydroxyalkyls; and $R_2$ and $R_3$ are preferably H or OH.

USE OF COMPOSITIONS AS PERMANENT PRESS AGENTS

The compounds of this invention can advantageously be used as permanent press agents for fabrics composed partially or entirely of cellulose, such as cotton, or celluloselike materials including cellulose/polymer (natural or synthetic) composites. These compounds can be used to replace the formaldehyde-derived adducts and other materials currently employed as permanent press agents, to achieve a fabric that is wrinkle-resistant and self-smoothing.

While the applicants do not wish to be bound by theory, it is postulated that the compounds of this invention penetrate the cellulose or cellulose-like fibers in the fabric and act to crosslink them resulting in a fabric which has strong wrinkle-resistant properties and is suitable for use in wearing apparel. Further, because the compounds have no free amine hydrogens, any fabric treated with these agents can be exposed to chlorine bleach without the characteristic yellowing observed with many known nitrogen-containing permanent press agents. Thus, the fabrics treated with the compounds of this invention are especially suited for the manufacture of articles of wearing apparel.

The compounds are preferentially applied to the fabrics to be treated as compositions comprising a 0.1–10% (by weight) aqueous solution, preferably as an 8% solution. The solution may also contain ethanol to aid in the dissolution of the composition and, if desired, a curing agent (such as citric acid or magnesium chloride which promote crosslinking) at a low concentration, preferably 0.05–0.5%, by weight, most preferably 0.175%.

In a typical procedure, the fabric is soaked in the solution until it is saturated with liquid. The fabric is then lightly wrung or squeezed between pinch rollers, leaving a 50–90% wet pick up weight gain, and subsequently dried in a hot press at a temperature in excess of 100° C., preferably 150° C., for several minutes (preferably less than 5). The crosslinking of the fibers and curing is then accomplished by heating the fabric to a higher temperature, preferably 170° C. for 1–5 minutes. Optionally, the press drying can be preceded by an oven-drying step at a lower temperature, preferably 105° C., to partially dry the fabric and reduce the time that it must remain in the press; typically this procedure is used to remove a large portion (ordinarily 75–90%) of the water after which the press drying and subsequent curing is accomplished.

Once the crosslinking (curing) is accomplished, the resultant fabric will possess durable permanent press and self-smoothing properties and is suitable for use in the manufacture of wearing apparel and other textile commodities

EXAMPLES

Preparation of

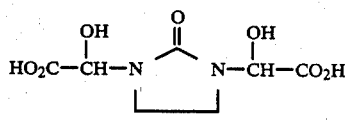

A total of 8.6 gm (0.10 moles) of cyclic ethylene urea (2-imidazolidinone), was dissolved in a 50% aqueous solution of glyoxylic acid (29.6 g., 0.20 mole). During this process, a slight exothermic reaction was observed. The mixture was then heated to 75° C. under a continuous vacuum (to remove the water). The reaction was continued for about 4–5 hours until the water removal was complete and a product in the form of a viscous oil was obtained. This oil was titrated against 0.1N sodium hydroxide, revealing a purity of 92%.

Infra-red and proton NMR spectra confirmed that this product had the desired above-noted structure.

Preparation of

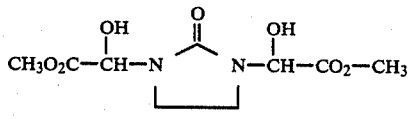

As in Example 4.1, one molar equivalent of ethylene urea was dissolved in 2 molar equivalents of the glyoxylate, in this case methyl 2-hydroxy-2-methoxyacetate. A mild exotherm occurred. The mixture was then heated with stirring, to a pot temperature of about 140° C. The reaction was discontinued after all of the methanol distilled-off, and a light brown liquid residue which solidified rapidly on cooling was obtained.

Infra-red and proton NMR analysis confirmed that the product was a diester and had the above structure. The material was water, alcohol, and methylene chloride soluble.

Preparation of

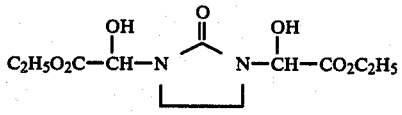

This material was prepared as in Example 4.2 using ethyl 2-hydroxy-2-ethoxyacetate as a starting material. The product was a hydroscopic pale yellow material that tended to easily melt and was soluble in hot water.

Preparation of

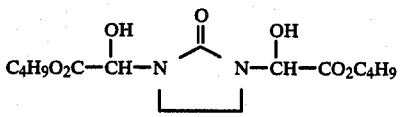

This material was prepared as in Example 4.2 repeated using butyl 2-hydroxy-2-butoxyacetate as a starting material. The product was a water-insoluble liquid.

Preparation of

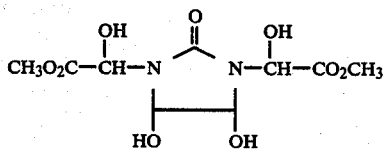

This material was prepared as in Example 4.2 using dihydroxyethylene urea and methyl 2-hydroxy-2-methoxyacetate as the starting materials. After cooling, the product was a dark brittle solid that was water soluble.

Preparation of

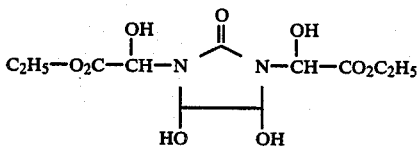

This material was prepared as in Example 4.2 using ethyl 2-hydroxy-2-ethoxy acetate and dihydroxyethylene urea as the starting materials. The product was a brown water soluble solid.

Preparation of

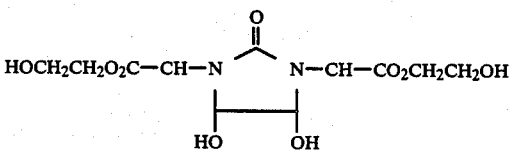

This material prepared as in Example 4.2 using 2-hydroxyethyl 2-hydroxy-2-(2'-hydroxyethoxy)acetate and ethylene urea as the starting materials. The product was a pale yellow liquid which was very water soluble.

Evaluation of Compositions as Permanent Press Agents

The compositions of Examples 4.2, 4.3, 4.5, and 4.6 were examined for their ability to impart permanent press properties to fabrics as follows. Each composition was prepared as an 8.0% (by weight) aqueous solution (in some cases ethanol was added to aid dissolution) and 0.175% (by weight) of a curing agent (citric acid or $MgCl_2$) was added. These solutions were then exposed to the test fabric, which was 100% cotton, bleached, mercerized 133×63 combed 2.94 broadcloth. The fabric was padded at approximately 70% wet-pick-up, partially dried in an oven at 105° C., pressed dry with a hot head press at 150° C., for 20 seconds and cured at 170° C. for 90 seconds.

The resultant treated fabric was then examined for its ability to resist wrinkling during laundering, and determination of its wash and wear rating. This rating is determined after 3-5 conventional home launderings by visually examining the fabric and comparing the number of wrinkles observed versus the number observed in an untreated control subjected to similar launderings. A rating of 2.0 or greater is considered to be evidence of good durability. The results are presented below:

| Example | Wash and Wear Rating |
|---|---|
| 4.2 | 2.8 |
| 4.3 | 2.6 |
| 4.5 | 2.3 |
| 4.6 | 2.0 |

As shown, it can be seen that all four materials exhibited good ratings.

It is apparent that many modifications and variations of this invention as hereinabove set forth may be made without departing from the spirit and scope thereof. The specific embodiments described are given by way of example only and the invention is limited only by the terms of the appended claims.

What is claimed is:

1. A compound having the structure

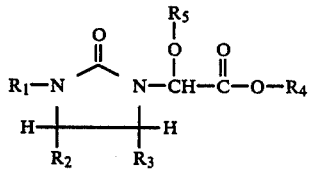

wherein:

$R_1$ is alkyl or

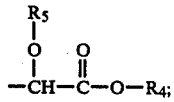

$R_2$ and $R_3$ are OH, H, or combine to form

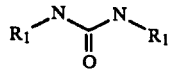

where $R_1$ may be the same at each position or different and the N atoms attach to the molecule at positions $R_2$ and R3;

$R_4$ is alkyl, H, or hydroxyalkyl; and $R_5$ is alkyl, H, or hydroxyalkyl.

2. The compound of claim 1, wherein $R_1$ is selected from the group consisting of methyl, ethyl, propyl, and butyl.

3. The compound of claim 1, wherein $R_4$ and $R_5$ are selected from the group consisting of methyl, ethyl, propyl, butyl, hydroxymethyl, hydroxyethyl, hydroxypropyl, and hydroxybutyl.

4. The compound of claim 1, wherein $R_2$ and $R_3$ are OH, $R_5$ is H, $R_4$ is alkyl, and $R_1$ is

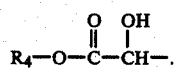

5. A method for producing a wrinkle-resistant and self-smoothing fabric composed partially or entirely of cellulose or cellulose-like materials which comprises:

a. treating said fabric with an effective amount of a composition containing a compound having the general formula

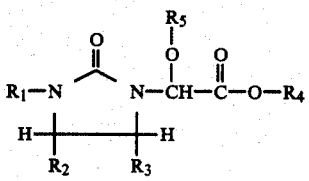

wherein:

$R_1$ is alkyl or

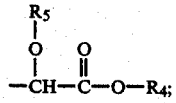

$R_2$ and $R_3$ are OH, H, or combine to form

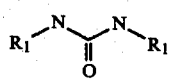

where $R_1$ may be the same at each position of different and the N atoms attach to the molecule at positions $R_2$ and $R_3$;

$R_4$ is alkyl, H, or hydroxyalkyl; and $R_5$ is alkyl, H, or hydroxyalkyl; and b. subsequently drying and curing said fabric for a sufficient time such that crosslinking of the cellulose and cellulose-like fibers occurs to render said fabric wrinkle-resistant and self-smoothing.

6. The method of claim 5, wherein $R_1$ is selected from the group consisting of methyl, ethyl, propyl, and butyl.

7. The method of claim 5, wherein $R_4$ and $R_5$ are selected from the group consisting of methyl, ethyl, propyl, butyl, hydroxymethyl, hydroxyethyl, hydroxypropyl, and hydroxybutyl.

8. The method of claim 5, wherein $R_2$ and $R_3$ are OH, $R_5$ is H, $R_4$ is alkyl, and $R_1$ is

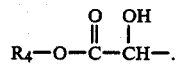

9. The method of claim 8, wherein $R_4$ is methyl or ethyl.

10. The method of claim 5, wherein the composition is present in an aqueous solution containing the compound at a concentration of 0.1–10% by weight.

11. The method of claim 10, wherein the aqueous solution further comprises a curing agent selected from the group consisting of citric acid and magnesium chloride and an effective amount of ethanol such that dissolution of the compound is achieved.

12. The method of claim 11, wherein the curing agent is present in the aqueous solution at a concentration of about 0.175%.

13. The method of claim 5, wherein the fabric is cotton.

14. The method of claim 5, wherein the drying is accomplished in a press at 150° C. and the curing is accomplished at 170° C.

15. The method of claim 14, wherein the drying in the press is preceded by drying the fabric in an oven at a temperature below 150° C. for a sufficient time to achieve removal of 75–90% of the water.

16. The method of claim 15, wherein the oven drying is performed at 105° C.

17. A compound which imparts permanent press properties to cellulose and cellulose-like textiles comprising the structure

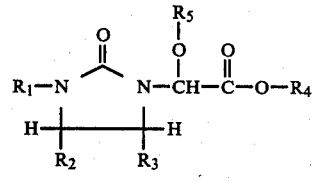

wherein:

$R_1$ is alkyl or

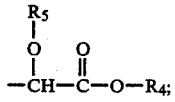

$R_2$ and $R_3$ are OH, H, or combine to form

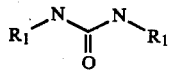

where $R_1$ may be the same at each position or different and the N atoms attach to the molecule at positions $R_2$ and $R_3$;

$R_4$ is alkyl, H, or hydroxyalkyl; and $R_5$ is alkyl, H, or hydroxyalkyl.

18. The compound of claim 17, wherein $R_1$ is selected from the group consisting of methyl, ethyl, propyl, and butyl.

19. The compound of claim 17, wherein $R_4$ and $R_5$ are selected from the group consisting of methyl, ethyl, propyl, butyl, hydroxymethyl, hydroxyethyl, hydroxypropyl, and hydroxybutyl.

20. A wrinkle-resistant and self-smoothing fabric produced by the method of claim 5.

* * * * *